United States Patent [19]

Huddleston

[11] 4,114,413

[45] Sep. 19, 1978

[54] BROKEN WIRE SWITCH APPARATUS

[75] Inventor: Paul W. Huddleston, Tallmadge, Ohio

[73] Assignee: Wean United, Inc., Pittsburgh, Pa.

[21] Appl. No.: 830,290

[22] Filed: Sep. 2, 1977

[51] Int. Cl.[2] ..... B21C 1/12

[52] U.S. Cl. ..... 72/5; 72/37; 72/289

[58] Field of Search ..... 72/4, 5, 31, 37, 274, 72/289; 242/57, 75.52; 83/63

[56] References Cited

U.S. PATENT DOCUMENTS

| | | | |
|---|---|---|---|
| 1,964,874 | 7/1934 | Fankboner | 242/57 |
| 1,988,486 | 1/1935 | Ferenci | 242/57 |
| 2,078,669 | 4/1937 | King | 242/57.1 |
| 2,122,796 | 7/1938 | Horton | 83/63 |
| 2,374,652 | 5/1945 | Cohen | 72/5 |
| 3,633,835 | 1/1972 | Beers | 242/57 |
| 3,635,413 | 1/1972 | Gish | 242/57 |
| 3,928,844 | 12/1975 | Meihofer | 242/57 |

*Primary Examiner*—Michael J. Keenan

*Attorney, Agent, or Firm*—Daniel Patch; Suzanne Kikel

[57] ABSTRACT

This disclosure pertains to a broken wire switch for use in conjunction with a wire drawing machine. It includes a light source and a light detector, both mounted on the common side of the path of travel of the wire. The light source and detector are arranged so that the radiation pattern of the light source and the field of view of the light detector intersect at a point in the normal path of travel of the wire. An electric switch associated with the light detector interrupts the operation of a windup block that advances the wire.

1 Claim, 3 Drawing Figures

BROKEN WIRE SWITCH APPARATUS

It has been customary in the design and operation of wire drawing machinery to provide a broken wire switch for interrupting the operation of the machine and particularly the windup block on the occasion of a breakage of the wire during the drawing operation. One type of previous wire switch has taken the form of a roller or shoe arranged to ride on the moving wire. When the wire inadvertently broke the roller or shoe no longer being supported by the wire would drop down and in so doing actuate an electrical switch to stop the machine. These broken wire switches were subject to wear and breakage and were a high maintenance item. Moreover, in the case of drawing very fine wire, the weight of the roller or shoe was additionally objectionable and required that the weight be counterbalanced.

The present invention provides a novel broken material switch designed to overcome each and every one of the above enumerated objections and disadvantages of previous broken material switches and provides instead a practically maintenance free, highly dependable and economical broken material switch for use with a machine for producing a continuous flow of material such as wire produced by a wire drawing machine.

A still further object of the present invention provides in combination with a machine for producing a continuous flow of material having an energy reflective characteristic, such as wire produced by a wire drawing machine, a switch for interrupting operation of the machine and hence the flow of material wherein the material flows in a general predetermined path of travel for at least a portion of its travel through the machine, an energy emitting means, means for maintaining said energy emitting means so that its energy is directed to intercept said path of travel of said material, an energy receiving means, means for mounting said energy receiving means on the same side of the path of travel as said energy emitting means so that it receives energy reflected by said material from said energy emitting means, said energy receiving means including means sensitive to the presence and absence of reflected energy from said energy emitting means, and means associated with said sensitive means of said energy receiving means to produce a control signal for causing interruption of the flow of material when because of a break in the continuous flow of material in said portion of its travel said energy receiving means fails to receive reflected energy from said energy emitting means.

These objects, as well as other novel features and advantages of the present invention, will be better understood when the following description of a preferred embodiment is read along with the accompanying drawings of which:

Figures 1, 2:
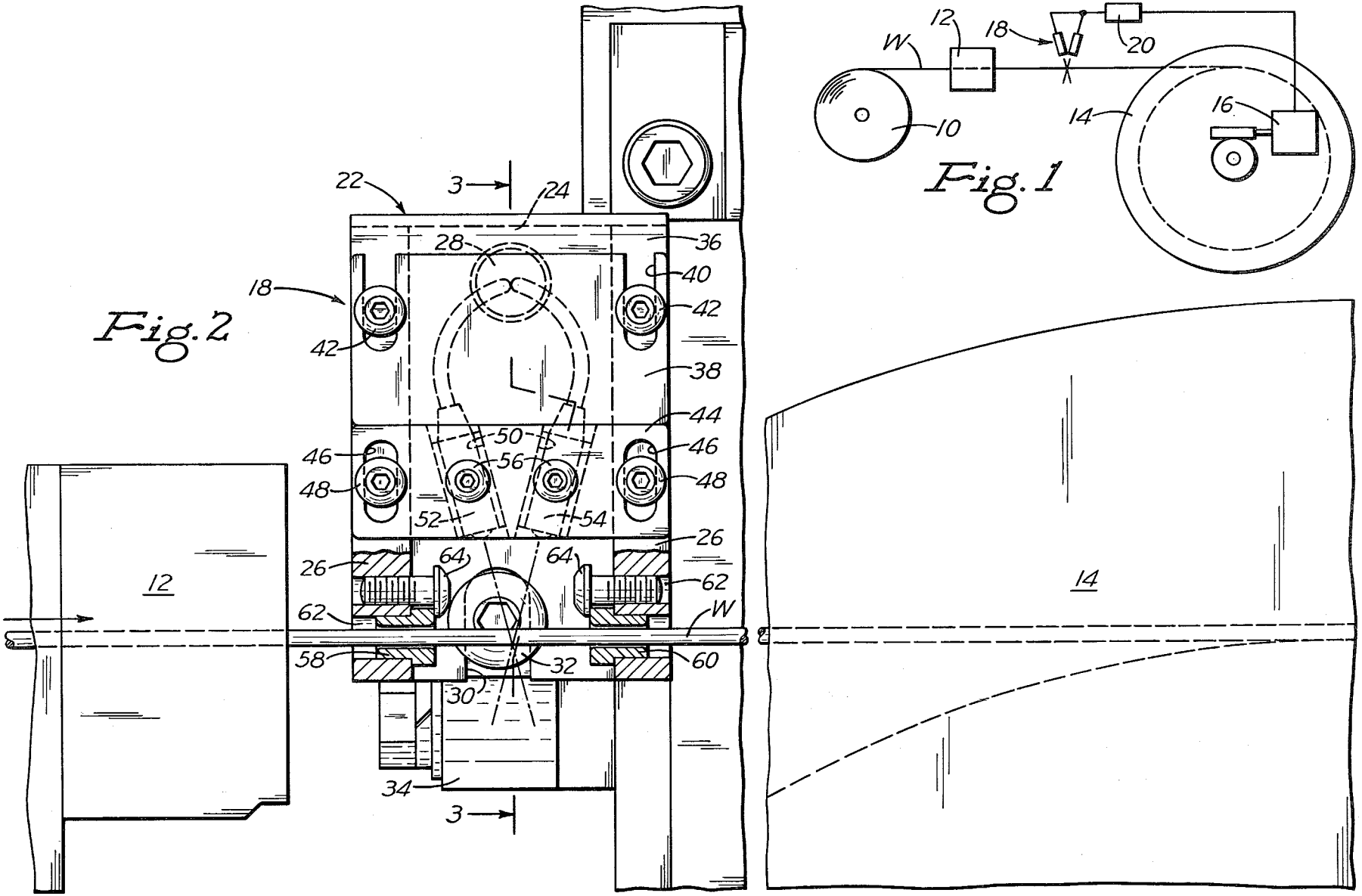
FIG. 1 is a schematic view illustrating, in combination with a wire drawing machine, a novel broken wire switch of an optical type built in accordance with the present invention.
FIG. 2 is an enlarged elevational view, partly in section, of the die assembly, broken wire switch, and windup block illustrated in FIG. 1.

In referring first to FIG. 1 there is illustrated a pay block 10 designed to supply wire stock from a coil or bundle in a continuous fashion to a die assembly 12 for drawing thereby, which is followed by a windup block 14 having an electric motor and gear drive 16, the block furnishing a control tension on the wire to draw it through the die assembly. Since these components are all well known in the art no further description is deemed necessary to understand the present invention. Between the die assembly 12 and the windup block 14 is located a broken wire switch 18, built in accordance with the teaching of the present invention. Associated with the switch 18 is an electrical switch 20 that is arranged in the electrical circuit of the windup block 14 in which when in its open position interrupts the operation of the motor 16.

Figure 3:
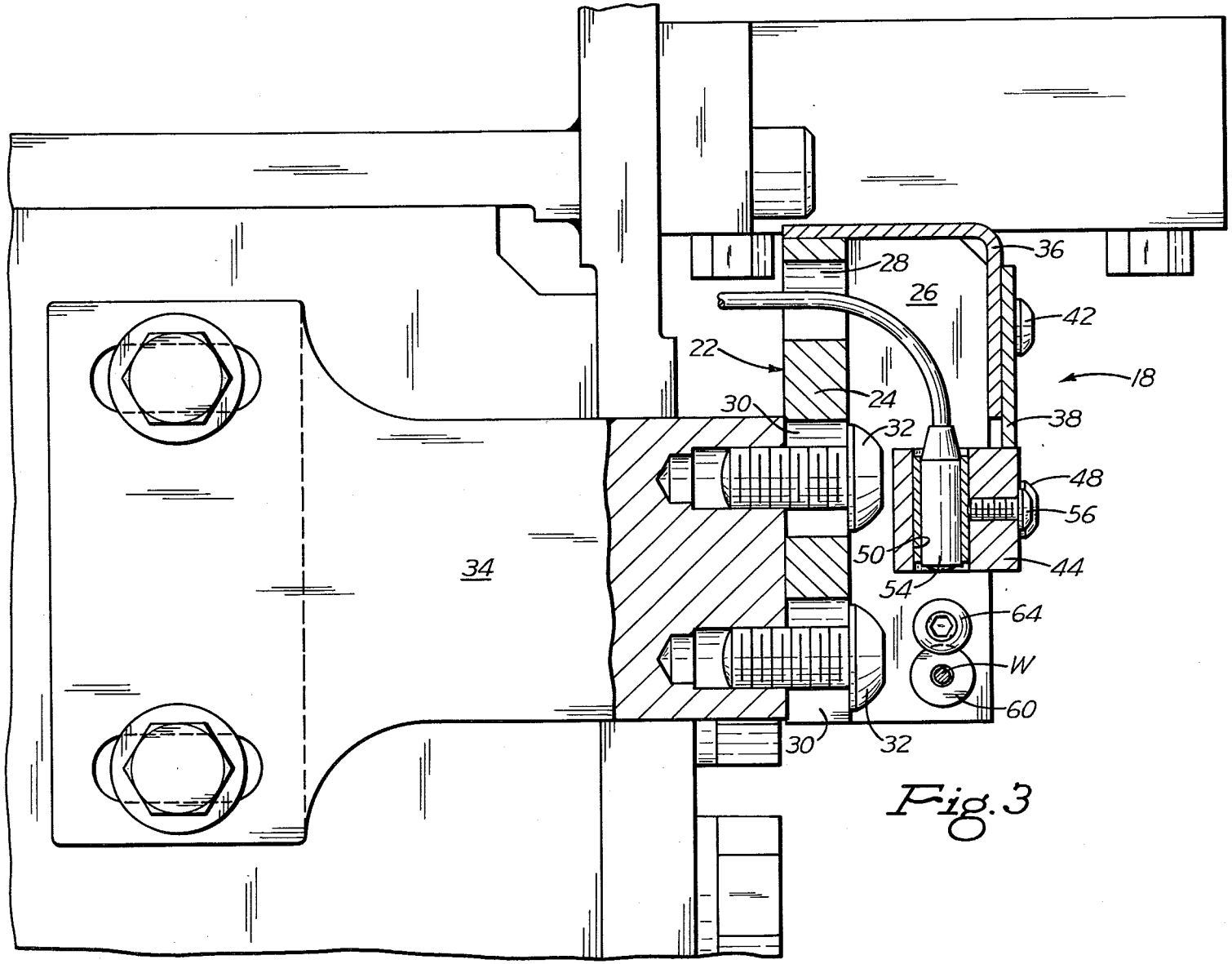
FIG. 3 is a sectional view taken on lines 3—3 of FIG. 2.

FIGS. 2 and 3 illustrate the essential details of the broken wire switch 18. Also shown in FIG. 2 is part of the die assembly 12 and a portion of the capstan of the windup block 14. The preferred form of the switch 18 is an optic device in which both the light source and light detector are arranged on the same side of the passing wire W in which the detector is arranged to receive the reflection of energy from the wire. Accordingly, the device 18 is mounted in a U-shaped frame 22 having a central back plate 24 and two end posts 26.

The back plate 24 is provided with three centrally located holes, one 28 to receive the electrical conduits for the switch 18, and two others 30 for receiving bolts 32 for securing the frame 22 to a support member 34. On similar front surfaces of the end posts 26 of the frame 22 arranged to fit across its upper portion so as to cover the opening of the "U"-frame, is a guard plate 36. This plate carries a second guard plate 38 having slotted openings 40 for receiving a pair of bolts 42, the bolts also serving to secure the guard plate 36 to the end posts 26 of the frame, for which purpose the plate 36 has circular openings, not shown. The guard plate 38 at lower end contacts as shown in FIG. 2 a horizontal block 44 that enters into the opening formed by the guard plate 36, and extends across the path of travel of the wire W as best shown in FIG. 3. The block 44 is provided with two enclosed slots 46 which receive bolts 48 for securing the block 44 to the end posts 26.

The block 44 has two converging openings 50 for receiving a light source unit 52 and a light receiving unit 54. These units may be any one of several readily available commercial devices, such as an "Opcon Sensor" manufactured by the Wood Compton Company of Cleveland, Ohio. From the particular arrangement of parts and geometry illustrated, the angle of the light receiver and detector 52 and 54 respectively, is approximately 30° and as shown in FIG. 2, the apex of the angle intersects at a point where wire passes beneath the units 52 and 54. Because of the arrangement of the units, as subscribed, the point of intersection with the wire is not critical in the sense that it will not accommodate slight movement of the wire, different light angles and different size wire without requiring adjustment.

The light source unit 52 and reflector unit 54 are adjustably mounted in openings 50 by individual set screws 56. As shown in both FIGS. 2 and 3, the electrical leads from the unit 52 and 54, extend into and through the opening 28 provided in the back plate 24. Also mounted in the end posts 26 of the frame 22 are entry and delivery wire guiding members 58 and 60, held in openings 62 by set screws 64. To minimize wear, the members 58 and 60 can be made up out of ceramic or tungsten carbide.

In operation the light from the light source unit 52 will be reflected off the passing wire and picked up by the detector unit 54. However, on the occasion of the wire inadvertently breaking between the die assembly 12 and the block 14, the unit 54 will cease to receive reflected light from the wire and cause the electrical switch 18 to immediately operate to interrupt the operation of the motor 16 associated with the windup block 14. It will be appreciated by those skilled in the art that the operativeness of the electrical switch 18 will be controlled to recognize non-operating conditions of the wire machine such as when the leading end of a new coil or bundle is being fed through the die prior to the commencement of the die drawing operation so that the electrical switch 18 will not interfere with the operation of the motor 16.

In accordance with the patent statutes, I have explained the principles and operation of my invention, and have illustrated and described what I consider to represent the best embodiment thereof.

I claim:

1. In combination with a machine for producing a continuous flow of material having an energy reflective characteristic, such as wire produced by a wire drawing machine, a switch for interrupting operation of the machine and hence the flow of wire wherein the wire flows in a generally predetermined path of travel for at least a portion of its travel through the machine, an energy emitting means, means for maintaining said energy emitting means so that its energy is directed to intercept said path of travel of said wire, an energy receiving means, means for mounting said energy receiving means on the same side of the path of travel as said energy emitting means so that it receives energy reflected by said wire from said energy emitting means, said energy receiving means including means sensitive to the presence and absence of reflected energy from said energy emitting means, guide means made up of high wear-resistant material, each having openings for receiving said wire immediately before and after passing through said point of interception, for maintaining said wire in said predetermined path of travel, each said guiding means including a reduced portion for receipt thereof into different openings formed in said mounting means, said openings being arranged concentric with said path of travel of said wire, said guiding means each having opposed enlarged portions on the side most adjacent said point of interception, and holding means for each guiding means carried by said mounting means and arranged to engage said enlarged portions of said guiding means for securing said guiding means to said mounting means.

* * * * *